US006431726B1

(12) United States Patent
Barton

(10) Patent No.: US 6,431,726 B1
(45) Date of Patent: Aug. 13, 2002

(54) FOLDING AND ADJUSTABLE SIDE-SLIDING FLUORESCENT LAMP FIXTURE

(76) Inventor: Bina M Barton, P.O. Box 131, Sunset Beach, CA (US) 90742

( * ) Notice: Subject to any disclaimer, the term of this patent is extended or adjusted under 35 U.S.C. 154(b) by 0 days.

(21) Appl. No.: 09/877,785

(22) Filed: Jun. 11, 2001

(51) Int. Cl.[7] ..... F21V 19/02

(52) U.S. Cl. ..... 362/220; 362/217; 362/219; 362/225; 362/239; 362/232; 362/290

(58) Field of Search ..... 362/220, 217, 362/219, 221, 225, 232, 239, 290, 285

(56) References Cited

U.S. PATENT DOCUMENTS 6,217,190 B1 * 4/2001 Altman et al. ..... 362/217

* cited by examiner

*Primary Examiner*—Sandra O'Shea
*Assistant Examiner*—M. Tsidulko
(74) *Attorney, Agent, or Firm*—Monty Koslover

(57) ABSTRACT

Two or more single linear fluorescent lamp reflector housings are pivotably joined together so that at least one end of each single reflector housing overlaps an adjacent reflector housing. Provision is made for each reflector housing to be folded around or slid rectilinearly along the side of its adjacent reflector housing, thus adjusting the overall length of the fixture for installation. Shadowing effects caused by spaces between the ends of individual lamps are eliminated by the overlaps, and the fixtures may be folded for shipping or storage, requiring only a short packing length.

4 Claims, 3 Drawing Sheets

FOLDING AND ADJUSTABLE SIDE-SLIDING FLUORESCENT LAMP FIXTURE

BACKGROUND OF THE INVENTION

1. Field of the Invention

This invention relates to linear fluorescent lamp fixtures, and more particularly to a new type of multiple lamp fixture.

2. Background

Linear fluorescent lamp fixtures and lamps come in a number of different lengths and are used in many commercial, industrial, and even residential lighting applications. When the lamp fixtures are installed with the fixtures in line, one after the other, there is inevitably a shadow area formed between the ends of adjacent lamps as well as at the ends of the fixture run. This shadowing effect may not matter for a large ceiling installation such as used in supermarkets or warehouses. However, it often does matter to commercial establishments such as jewelers, or other stores having small articles where lighting needs to be uniform for proper display.

An ongoing problem for installers of linear fluorescent fixtures is what to do when a line of fluorescent fixtures will not fit the space allotted for them. This situation is often solved by substituting one or more different length lamp fixtures at an end of the line run. Since there are only a few standard length lamps and fixtures available, the substitution approach may not always work, and a gap in the run is created.

As a result of the foregoing effects, a commercial user of a linear fluorescent lamp fixture installation has to put up with unwanted shadowing of his business property and displays, and may also have to stock different size fluorescent lamps for replacement.

Recently, a new type of linear fluorescent lamp fixtures has been offered for sale, having two or three single lamp reflector housings that are welded together or otherwise fixed so that an end of one reflector housing overlaps the end of another. This solution certainly eliminates the light shadowing problem caused by a space between single lamp fixture ends, but does not avoid a possible need to use odd length lamp fixtures for a given installation to avoid end gaps and shadowing. Also, the newly available fixed, double or triple lamp reflector housing fixtures now require a particularly long length package for shipping and storing, which is not desirable. Thus, these new fixtures represent only a partial solution to the problems discussed above.

SUMMARY OF THE INVENTION

The invention is a group of two or more single linear fluorescent lamp reflector housings that are joined together so that at least one end of each single reflector housing overlaps its adjacent reflector housing. It is adapted to permit each reflector housing to be folded around or slid along the side of its adjacent reflector housing, thus changing the overall length of the fixture for installation.

Accordingly, it is a prime object of the present invention to provide a linear fluorescent lamp fixture that will eliminate any shadowing effects caused by spaces between the ends of individual lamps.

Another object is to eliminate any need for substitution of odd sized lamps where runs of same size lamps do not fill the required space.

An advantage of the invention over other approaches is that the invention fixture can be folded for shipping and requires the same length packing box as a single linear fluorescent lamp fixture.

Further objects and advantages of the invention will be apparent from studying the following portion of the specification, the claims and the attached drawings.

DESCRIPTION OF THE PREFERRED EMBODIMENT

Figure 1:
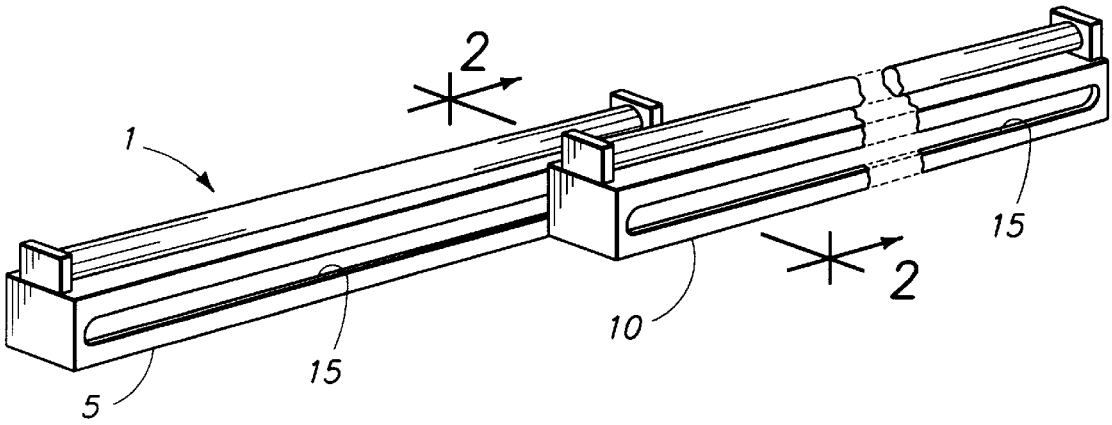
FIG. 1 is a perspective view of a two-lamp linear fluorescent fixture according to the present invention, particularly showing a longitudinal slot on a side of each reflector housing.

Referring particularly to the drawings, there is shown in FIG. 1 a perspective view of a two-lamp fixture 1 according to the present invention, with installed lamps. Two identical linear fluorescent lamp reflector housings 5, 10, are attached at one end so that the two ends overlap. In each lamp reflector housing, a slot 15 is cut longitudinally in one side for the purpose of letting one attached housing slide longitudinally with respect to the other. Except for the slot on one side and extra side holes on the opposite side, the lamp reflector housings are standard in construction and size, and are sized to accommodate the commonly available lengths of linear fluorescent lamps.

Figure 2:
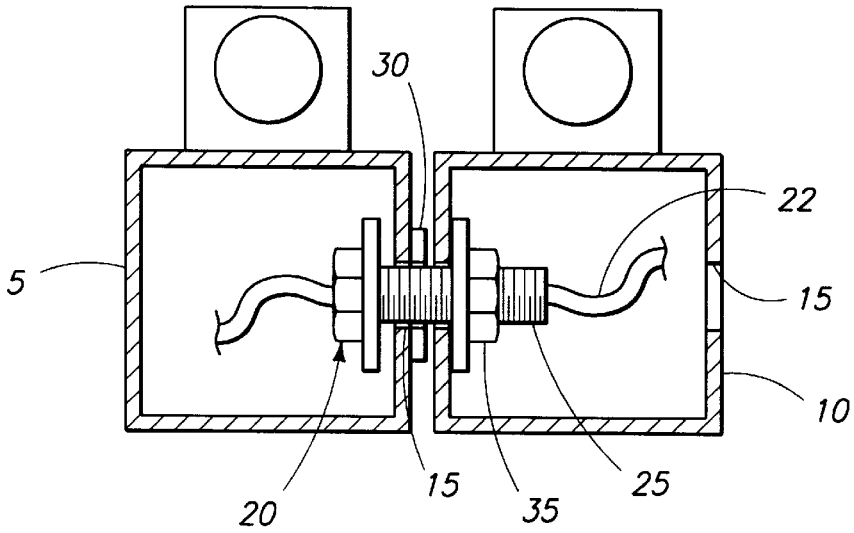
FIG. 2 is a cross-section view of the two-lamp fixture taken along line 2—2 of FIG. 1, particularly showing the means for joining the two reflector housings to allow pivoting and sliding the reflector housings.
Figure 4:
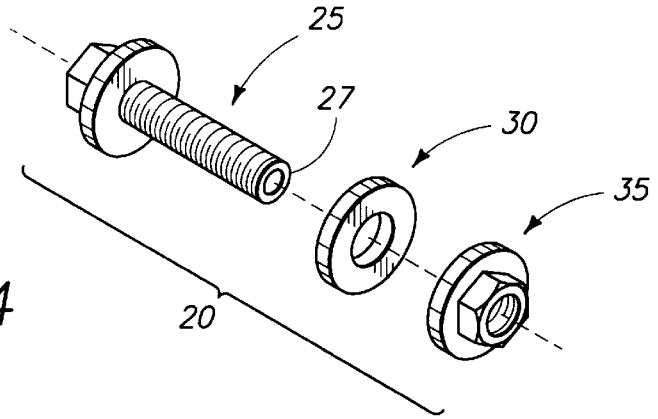
FIG. 4 is an exploded view of the slidable connector assembly which is used to connect any two reflector housings.

Referring now to FIG. 2, a cross-section of the two-lamp fixture taken along line 2—2 of FIG. 1 shows a slidable connector 20 that is installed in place, enabling a first lamp reflector housing 5 to connect to a second lamp reflector housing 10. The slidable connector 20 assembly is shown in exploded view in FIG. 4 and consists of a threaded bolt 25 that incorporates a washer at its head, a flat washer 30 to separate the two lamp reflector housings and a fastening nut and lock washer 35. The bolt 25 has a through hole 27 bored along its axis to allow insertion of electrical power wiring. As depicted in FIG. 2, the bolt 25 body is inserted through the slot 15 in the side of the first lamp reflector housing 5; the separator washer 30 is placed over the bolt and the bolt body then inserted through a hole 16 in the side of the second lamp reflector housing 10. A fastening nut with attached lock washer 35 is then applied to tighten the bolt 25 to the second lamp reflector housing 10. The power wires 22 can then be inserted through the slidable connector 20 for electrical connection as required.

After the slidable connector 20 is installed, either lamp reflector housing may be moved along a slot with respect to the other lamp reflector housing, or be rotated while still being mechanically and electrically connected together. This permits adjustment of the overall fixture length to whatever is required to fit a specific lamp run to its required space without leaving gaps.

Figure 3:
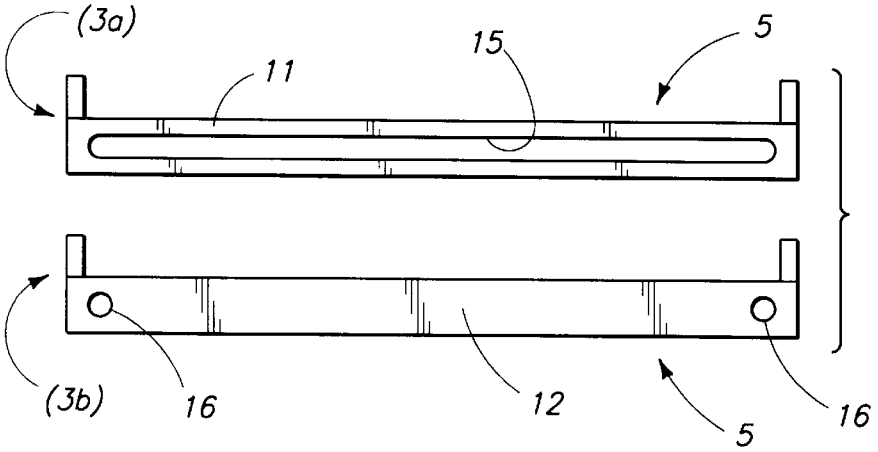
FIG. 3 shows the two longitudinal parallel sides of a linear lamp reflector housing, adapted according to the present invention.

Referring now to FIG. 3, the two sides of a lamp reflector housing 5 are shown. In the view (3*a*), one side designated as the right side 11 has a slot 15 cut in it, along almost its entire length. In the view (3*b*), the left side 12 has two wiring holes 16 cut in it, one hole being placed near to each end of the side and directly across from the ends of the slot 15 on the opposing face. These wiring holes 16 are for the insertion of either the bolt 25 of the slidable connector 20 for fastening thereto or for insertion of electrical power wiring. The holes 16 are thus positioned to ensure that when the lamp reflector housings are connected, one lamp reflector housing will substantially overlap the other at all times, leaving no space between lamp ends.

Figure 5:
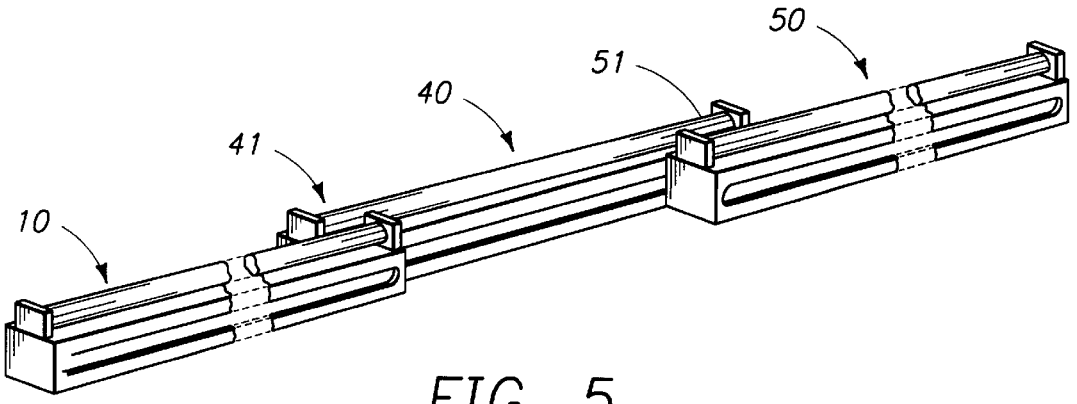
FIG. 5 is a perspective view of a three-lamp linear fluorescent fixture according to the present invention.

Although only a two-lamp fixture as in FIG. 1 has been presented and described so far, the invention includes a multiple number of connected lamp reflector housings that may comprise the same length or varying length lamps. As an example, FIG. 5 shows a three-lamp fixture with lamps, according to the present invention. The three single lamp reflector housings here 10,40,50, are joined at two ends 41, 51 and require two slidable connectors 20 for joining as described earlier. The lamp reflector housings are identical to those described earlier for a two-lamp fixture, so that there is no difference between the two fixtures except perhaps for overall length.

Figure 6:
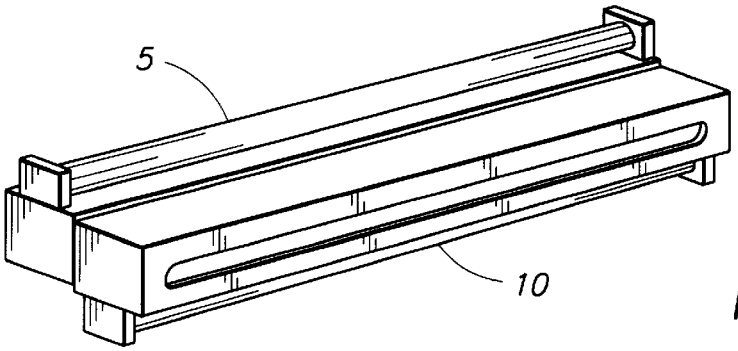
FIG. 6 is a perspective of a two-lamp fixture according to the present invention, folded for shipping or storage; and, FIG. 7 is an illustration of the process of unfolding the invention two-lamp fixture and adjusting its overall length prior to installation.
Figure 7:
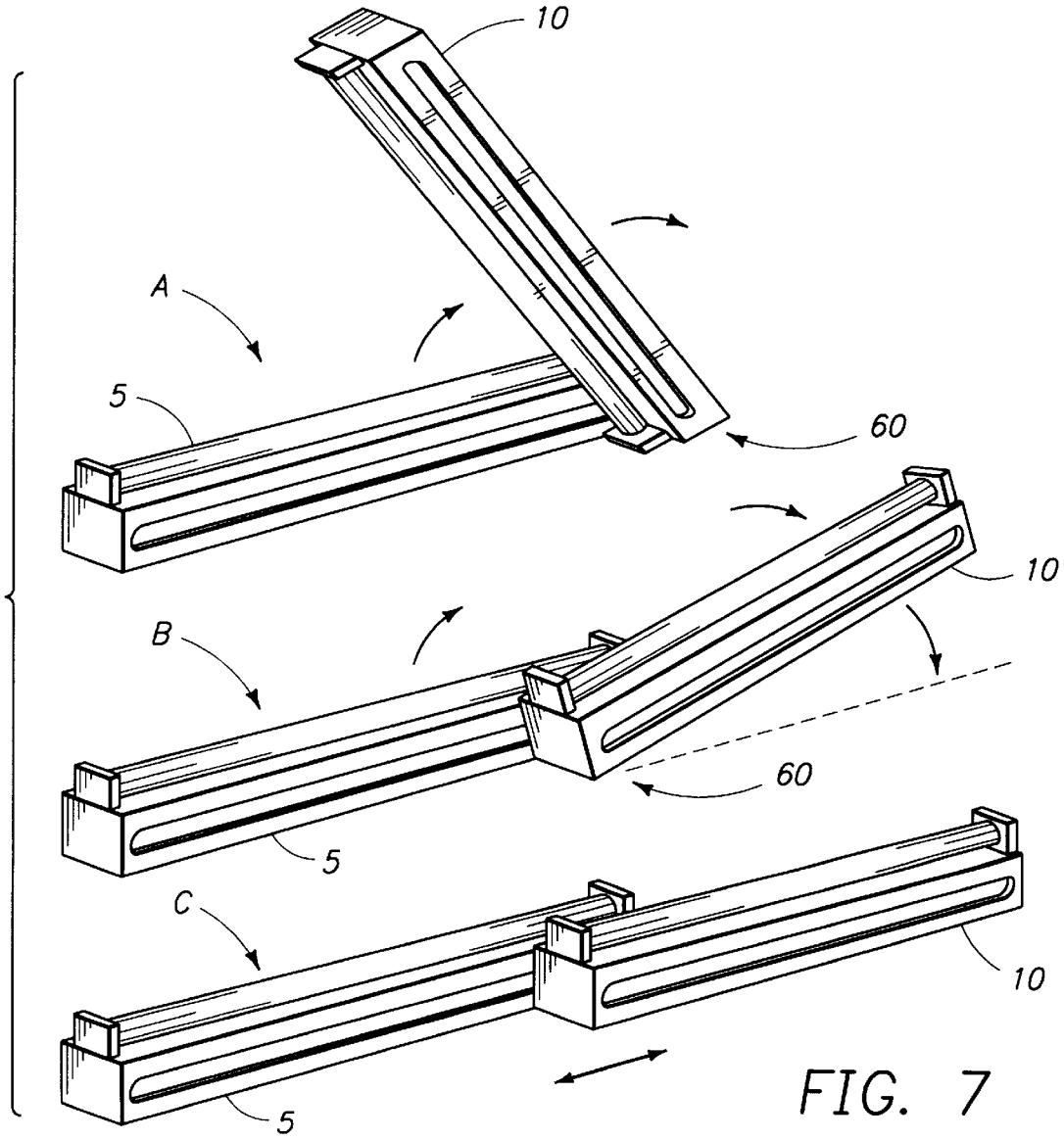

Referring now to FIGS. 6 and 7, there is shown a perspective view of a folded two-lamp linear fluorescent fixture according to the present invention, and an illustration of the process of unfolding the fixture prior to installation.

From FIG. 6, it is evident that the overall length of the two-lamp fixture to be packed for shipping is no greater than for a single linear fluorescent lamp reflector housing. This attribute also applies to a three or four-lamp fixture.

The process of unfolding the fixture begins with step A of FIG. 7, which is to pick up the non-fastened end of the second lamp reflector housing 10 and rotate it around the first lamp reflector housing 5 while pivoting on its fastened end 60. In step B, the rotation is continued until both lamp reflector housings are in the same plane with their lamps on top and one lamp end overlapping the other lamp. Step C is for adjusting the overall length of the fixture if that is required to fit a given space. Adjusting the fixture length is done by simply holding one lamp reflector housing in place and sliding the other lamp reflector housing toward it until the correct fixture length is achieved. There is usually no need to tighten the reflector housings together, but if that becomes necessary, it can be done by tightening the slidable connector locknut through the lamp reflector housing slot.

In any of the invention fixtures, all the lamps and their reflector housings would normally be the same in length. However, the fixtures could be made using mixed length housings if that was desirable, and still be able to fold and slide as needed. This is left as a possible consideration for lighting designers.

The above described invention adaptations to the familiar single linear fluorescent lamp fixture are simple in nature and relatively inexpensive to produce. It is expected that the new fixture use will therefore add little extra cost to that incurred for a present day installation, and may even cost less when labor cost is included.

In summary, the advantages offered by the invention are as follows:

1. Shadowing between the ends of installed lamps is eliminated, and an even wash of light is provided on all illuminated areas.
2. The adjustable length of the lamp fixture allows all lamps used in a run to be the same length, removing any need for keeping odd length lamps in stock for maintenance replacement.
3. The folding fluorescent lamp fixture can be packaged in a very short length package for shipping or storage.
4. The invention fixture may be employed using a multiple number of reflector housings and lamps connected together to form a run.

From the foregoing description, it is believed that the preferred embodiment achieves the objects of the present invention. Alternative embodiments and modifications will be apparent to those skilled in the art. These and other modifications are considered to be equivalent and within the spirit and scope of the present invention.

Having described the invention, what is claimed is:

1. A foldable and adjustable length, linear fluorescent lamp fixture, comprising:

a first lamp reflector housing and a second lamp reflector housing, each said lamp reflector housing being sized for a single, linear lamp; said first lamp reflector housing being connected to said second lamp reflector housing with the end of one housing overlapping the end of the next housing; and means for slidable and foldable connection of said first lamp reflector housing to said second lamp reflector housing;

each said reflector housing having a longitudinal slot cut along the length of one side and extending to near both ends of said housing, and first and second wiring holes cut in the opposing side, said first and second wiring holes each being located near to each end of said reflector housing, opposite the ends of said longitudinal slot;

said means for foldable and slidable connection being attached in sliding engagement to a reflector housing through said slot in the side of said reflector housing, and being fastened to a second reflector housing through one of said wiring holes; either reflector housing being then able to move in rectilinear sliding movement with respect to the other housing for adjustment of fixture length, or to be rotated and folded around the attached reflector housing for storage.

2. The linear fluorescent lamp fixture according to claim 1, wherein said means for foldable and slidable connection includes:

a threaded bolt incorporating a washer at its head; said bolt having a through hole bored the length of its axis creating a passage for electric power wiring;

a flat washer; and a fastening nut incorporating a lock washer;

said flat washer being attached to said bolt and separating the facing sides of two adjacent reflector housings that are connected by passage of said bolt through said slot and one of said wiring holes;

said fastening nut, being tightened on the end of said bolt sufficient to secure the bolt, and permitting one said reflector housing to be folded around or slid rectilinearly along a slot with respect to another reflector housing, while maintaining a close mechanical connection.

3. A foldable and adjustable length, linear fluorescent lamp fixture, comprising:

a multiplicity of lamp reflector housings, each reflector housing being sized for a single linear lamp, each reflector housing being connected to the next reflector housing with the end of one housing overlapping the end of the next housing; and means for slidable and foldable connection of each lamp reflector housing to the next lamp reflector housing in the fixture;

each said reflector housing having a longitudinal slot cut along the length of one side and extending to near both ends of said housing, and first and second wiring holes cut in the opposing side, said first and second wiring holes each being located near to each end of said reflector housing, opposite the ends of said longitudinal slot;

said means for foldable and slidable connection being attached in sliding engagement to a reflector housing through said slot in the side of said housing, and being fastened to a second reflector housing through one of said wiring holes; either reflector housing being then able to move in rectilinear sliding movement with respect to the other housing for adjustment of fixture length, or to be rotated and folded around the attached housing for storage.

4. The linear fluorescent lamp fixture according to claim 3, wherein said means for foldable and slidable connection includes:

a threaded bolt incorporating a washer at its head; said bolt having a through hole bored the length of its axis creating a passage for electric power wiring;

a flat washer; and a fastening nut incorporating a lock washer;

said flat washer being attached to said bolt and separating the facing sides of two adjacent reflector housings that are connected by passage of said bolt through said slot and one of said wiring holes;

said fastening nut, being tightened on the end of said bolt sufficient to secure the bolt, and permitting one said reflector housing to be folded around or slid rectilinearly along a slot with respect to another reflector housing, while maintaining a close mechanical connection.

* * * * *